United States Patent [19]

Fildan

[11] 4,425,689

[45] Jan. 17, 1984

[54] SEPARABLE FASTENER FOR GARMENTS, BELTS AND THE LIKE

[76] Inventor: Gerhard Fildan, Dieselstr. 20, 7250 Leonberg, Fed. Rep. of Germany

[21] Appl. No.: 367,026

[22] Filed: Apr. 9, 1982

[30] Foreign Application Priority Data

Jul. 13, 1981 [DE] Fed. Rep. of Germany ... 8120432[U]

[51] Int. Cl.[3] ..... A44B 11/26

[52] U.S. Cl. ..... 24/664

[58] Field of Search ..... 24/211 R, 230 R, 230 AK, 24/230 A

[56] References Cited

U.S. PATENT DOCUMENTS

| | | | |
|---|---|---|---|
| 4,035,877 | 7/1977 | Brownson et al. | 24/230 R |
| 4,093,271 | 6/1978 | Weigl et al. | 24/230 R |
| 4,195,392 | 4/1980 | Ueda et al. | 24/230 A |

*Primary Examiner*—Robert P. Swiatek
*Assistant Examiner*—David I. Tarnoff
*Attorney, Agent, or Firm*—Karl F. Ross

[57] ABSTRACT

A fastener for a piece of apparel, e.g. a nursing bra, comprises a male and a female portion of resilient plastic material, the female portion being partly shaped as a substantially rectangular frame forming a guide channel for the introduction of a flat shank of the male portion which is integral with a tongue whose free end faces away from the leading end of the shank and forms a stepped transverse edge engageable with a shoulder of a cross-member of the frame in a locking position. A tab integral with the female portion occupies the frame opening on one side of the guide channel and has a free edge overlying the free end of the inserted tongue which is substantially narrower than the tab and can be released from its locking position by finger pressure upon that tab. An asymmetrical hump on the leading end of the shank prevents locking by coming to lie against an internal projection of the frame when the shank is introduced into the channel in an inverted position. The female portion may also be provided with an elastically deformable element tending to eject the inserted shank from the channel upon the disengagement of the tongue from the cross-member of the frame.

6 Claims, 5 Drawing Figures

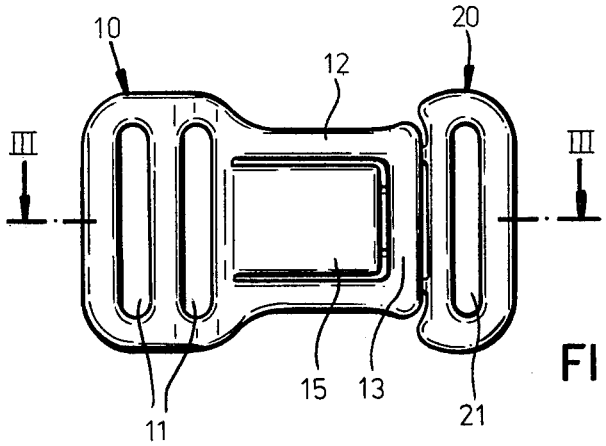
FIG.1
FIG.2
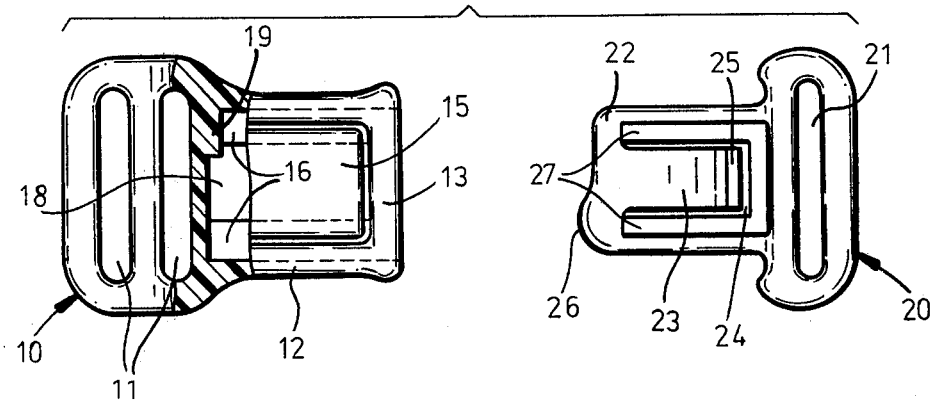
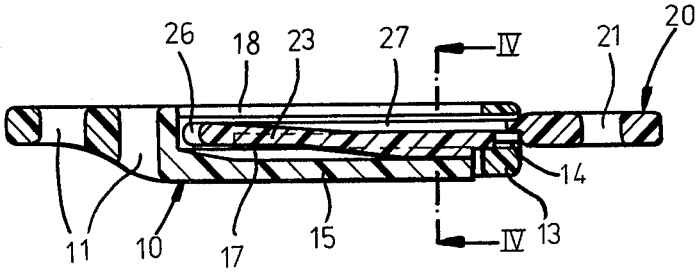
FIG.3

SEPARABLE FASTENER FOR GARMENTS, BELTS AND THE LIKE

FIELD OF THE INVENTION

My present invention relates to a fastener for a piece of apparel, especially an undergarment such as, for example, a nursing bra.

BACKGROUND OF THE INVENTION

A fastener of the type here contemplate, described in U.S. Pat. No. 3,200,464, comprises a male and a female portion of resilient plastic material provided with respective strap-engaging means such as hooks or eyes. The female portion forms a guide channel which is bounded by a substantially rectangular frame and has a cross-member remote from its strap-engaging means, a slot of this cross-member registering with the guide channel to enable the insertion of a flat shank of the male portion into the latter. A tongue attached to the leading end of the shank extends rearward within a cutout thereof from which it resiliently projects; a free edge of that tongue is engageable with a shoulder of the cross-member in a fully inserted position of the shank, referred to hereinafter as a locking position, to prevent a spontaneous separation of the two portions from each other.

The fastener can be opened by a disengagement of the tongue from the cross-member of the frame. The tongue is accessible for this purpose from the side of the frame opposite the inserted shank; this access opening, however, is rather narrow in small fasteners of the type here primarily considered in which the shank of the male portion has a width on the order of 1 cm. The user, therefore, will generally be able to reach the even narrower tongue only with a fingernail or possibly with a pointed tool, neither of which is very convenient.

OBJECT OF THE INVENTION

The object of my present invention, therefore, is to provide an improved fastener of the general type referred to in which this inconvenience is avoided.

SUMMARY OF THE INVENTION

I realize this object, in accordance with my present invention, by providing the female fastener portion with a tab extending within its frame, codirectionally with the tongue of the inserted shank, toward the aforementioned cross-member and overlying the tongue in the locking position, this tab normally being substantially flush with the frame to prevent its inadvertent depression. Inward deflection of the tab by finger pressure disengages the tongue and allows the shank of the male portion to be extracted from the channel of the female portion.

Since it is no longer necessary to reach through the frame opening in order to release the tongue, disengagement can be brought about by the tip rather than the nail of a finger even when the fastener is rather small.

Advantageously, the inward deflection of the tab is limited by a stop preventing an excessive deformation of the tongue. For this purpose I prefer to provide the tab with a recess facing the channel and accommodating part of the tongue in the locking position, this recess being bounded by a pair of ridges flanking the tongue and coming to rest upon the shank itself when the tab is depressed.

According to a further feature of my invention, the frame may have an edge opposite its slotted cross-member provided with an asymmetrical internal projection against which a hump on the leading edge of the shank comes to lie so as to prevent full insertion and locking if, through error, the shank is introduced into the slot of the cross-member in an inverted position in which the tongue is located on the side remote from the tab. Normally, upon correct insertion, the projection is offset from the hump.

Such a projection, or some other element of the frame, may be so shaped as to exert upon the inserted shank a force tending to eject it from the guide channel upon the disengagement of the tongue from the shoulder of the cross-member. This will result in a snap separation of the two fastener portions when the tab is depressed.

BRIEF DESCRIPTION OF THE DRAWING

The above and other features of my invention will now be described in detail with reference to the accompanying drawing in which:

FIG. 1 is a bottom view of an assembled fastener embodying my invention;

FIG. 2 shows a partly broken-away female portion and a male portion of the fastener, again in a face view, separated from each other;

FIG. 3 is a longitudinal sectional view of the assembled fastener, drawn to a scale larger than that of the preceding Figures;

SPECIFIC DESCRIPTION

Figure 4:
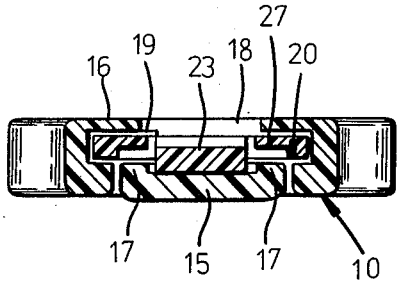
FIG. 4 is a cross-sectional view taken on the line IV—IV of FIG. 3.

The fastener shown in FIGS. 1–4 has a female portion 10 with two strap-engaging eyes 11 and a male portion 20 with one strap-engaging eye 21, both molded integral from elastic resinous material. Female portion 10 has a frame 12 with a cross-member 13 at an end remote from eyes 11, this member being formed with a slot 14 (FIG. 3) giving access to a guide channel defined by frame 12. Male portion 20 has a flat shank 22 insertable into that channel through slot 14, this shank being integral with a tongue 23 extending rearwardly from its leading end within a cutout 24, bounded by a rabbeted zone 27, which is substantially narrower than the guide channel. Tongue 23 is so biased that a stepped free edge 25 thereof engages an internal shoulder of cross-member 13 in a locking position illustrated in FIGS. 1 and 3.

In accordance with my present invention, frame 12 is integral with a tab 15 codirectional and closely juxtaposed with tongue 23 in the locking position as best seen in FIG. 3. Tongue 23, in that position, is bracketed by two ledges 16 of frame 12 which are located on the side opposite tab 15 and confront ridges 17 of the tab bounding a recess which receives part of the considerably narrower tongue 23 in the locking position. Ledges 16 are separated by a gap 18 which is narrower than tab 15 but slightly wider than tongue 23 to avoid any squeezing of the tongue against the opposite frame parts when the tab 15 is deflected inward to disengage the tongue from frame member 13. Gap 18 also facilitates the molding of the somewhat narrower recess bounded by the ridges 17 of the tab. Depression of the tab by a finger of the user lets the ridges 17 come to rest on the rabbeted boundaries 27 of cutout 24 alongside tongue 23 to limit the deformation of the tongue under the exerted pressure.

As best seen in FIG. 2, frame 12 has a boss 19 forming an asymmetrical projection on an edge opposite cross-member 13, this boss being normally offset from a likewise asymmetrically positioned hump 26 on shank 22 when the latter is correctly introduced into the entrance slot 14 of the guide channel. If, however, the position of male portion is accidentally inverted, hump 26 comes to bear upon boss 19 and prevents a full insertion of the shank so that tongue 23 cannot interlock with cross-member 13 in a position in which tab 15 would be ineffectual.

Figure 5:
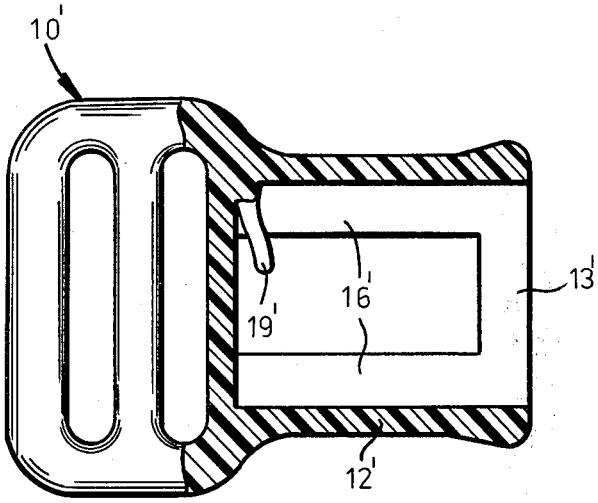
FIG. 5 is a view, similar to that of FIG. 2, of a modified female fastener portion according to my invention.

In FIG. 5 I have illustrated a modified female fastener portion 10' with frame member 12', ledges 16' and slotted cross-member 13' similar to their counterparts in the preceding Figures. Here, however, the projection or boss 19 has been replaced by an integral spring finger 19' which has the same inversion-preventing function but in addition exerts an ejection force upon the inserted shank 22 of the associated male portion even in the normal relative position of the two portions. This spring finger, therefore, thrusts the male portion 20 out of its locking position as soon as its tongue 23 is disengaged from member 13'. A similar ejection force could be created by letting the frame sides and the corresponding shank flanks converge at a suitable angle in the insertion direction, i.e. to the left in FIGS. 1–3 and 5.

Advantageously, as shown, tab 15 projects slightly beyond cross-member 13 to enable its detection by the mere touch of a finger.

I claim:

1. In a fastener for a piece of apparel, comprising a male portion and a female portion of resilient plastic material, each of said portions being provided with strap-engaging means, said female portion forming a guide channel bounded by a substantially rectangular frame with a cross-member remote from the strap-engaging means thereof having a slot registering with said channel, said male portion being provided with a flat shank insertable through said slot into said channel, said male portion further having a tongue attached to a leading end of said shank and extending rearwardly therefrom in a cutout of said shank while resiliently projecting from said cutout and terminating in a free edge engageable with a shoulder of said cross-member in a locking position of the fully inserted shank for preventing a spontaneous separation of said portions from each other, the improvement wherein said female portion is provided with a resilient tab extending codirectionally with said tongue toward said cross-member within said frame and overlying said tongue in the locking position of said male portion, said tab normally being substantially flush with said frame and inwardly deflectable by finger pressure for disengaging said tongue from said shoulder to enable said shank to be extracted from said channel, said tab having a recess facing said channel and accommodating part of said tongue in said locking position, said recess being bounded by a pair of ridges flanking said tongue, said ridges limiting the deflection of said tab by coming to rest on rabbeted boundaries of said cutout.

2. In a fastener for a piece of apparel, comprising a male portion and a female portion of resilient plastic material, each of said portions being provided with strap-engaging means, said female portion forming a guide channel bounded by a substantially rectangular frame with a cross-member remote from the strap-engaging means thereof having a slot registering with said channel, said male portion being provided with a flat shank insertable through said slot into said channel, said male portion further having a tongue attached to a leading end of said shank and extending rearwardly therefrom in a cutout of said shank while resiliently projecting from said cutout and terminating in a free edge engageable with a shoulder of said cross-member in a locking position of the fully inserted shank for preventing a spontaneous separation of said portions from each other, the improvement wherein said female portion is provided with a resilient tab extending codirectionally with said tongue toward said cross-member within said frame and overlying said tongue in the locking position of said male portion, said tab normally being substantially flush with said frame and inwardly deflectable by finger pressure for disengaging said tongue from said shoulder to enable said shank to be extracted from said channel, said channel and said tab being wider than said tongue, said frame having ledges transverse to said cross-member on the side of said channel opposite said tongue, said ledges being spaced apart by a gap narrower than said tab but wider than said tongue, said tab having a recess facing said channel and accomodating part of said tongue in said locking position, said recess being bounded by a pair of ridges flanking said tongue, said ridges limiting the deflection of said tab by coming to rest on rabbeted boundaries of said cutout.

3. In a fastener for a piece of apparel, comprising a male portion and a female portion of resilient plastic material, each of said portions being provided with strap-engaging means, said female portion forming a guide channel bounded by a substantially rectangular frame with a cross-member remote from the strap-engaging means thereof having a slot registering with said channel, said male portion being provided with a flat shank insertable through said slot into said channel, said male portion further having a tongue attached to a leading end of said shank and extending rearwardly therefrom in a cutout of said shank while resiliently projecting from said cutout and terminating in a free edge engageable with a shoulder of said cross-member in a locking position of the fully inserted shank for preventing a spontaneous separation of said portions from each other, the improvement wherein said female portion is provided with a resilient tab extending codirectionally with said tongue toward said cross-member within said frame and overlying said tongue in the locking position of said male portion, said tab normally being substantially flush with said frame and inwardly deflectable by finger pressure for disengaging said tongue from said shoulder to enable said shank to be extracted from said channel, said frame having an edge opposite said cross-member provided with an asymmetrically disposed resilient internal projection, said shank being provided at said leading end with an asymmetrical hump offset from said projection in said locking position, said hump preventing full insertion of said shank into said channel in an inverted position by coming to lie against said projection, the latter bearing in a normal position upon a part of said leading end spaced from said hump for yieldably resisting an insertion of said shank into said channel and exerting upon said male portion an ejecting force upon disengagement of said tongue from said shoulder, said tab having a recess facing said channel and accomodating part of said tongue in said locking position, said recess being bounded by a pair of ridges flanking said tongue, said ridges limiting the deflection of said tab by coming to rest on rabbeted boundaries of said cutout.

4. A fastener as defined in claim 1 or 2 wherein said channel and said tab are wider than said tongue, said frame having ledges transverse to said cross-member on the side of said channel opposite said tongue, said ledges being spaced apart by a gap narrower than said tab, but wider than said tongue.

5. A fastener as defined in claim 1 or 2 wherein said frame has an edge opposite said cross-member provided with an asymmetrical internal projection, said shank being provided at said leading end with an asymmetrical hump offset from said projection in said locking position, said hump preventing full insertion of said shank into said channel in an inverted position by coming to lie against said projection.

6. A fastener as defined in claim 1 or 2 wherein said female portion is provided with a resilient formation resisting an insertion of said shank into said channel and exerting upon said male portion an ejecting force upon disengagement of said tongue from said shoulder.

* * * * *